United States Patent [19]

Collier

[11] Patent Number: 5,040,999

[45] Date of Patent: Aug. 20, 1991

[54] ELECTRICAL CONNECTING ARRANGEMENT

[75] Inventor: John C. Collier, Southport, England

[73] Assignee: ITT Industries Limited, New York, N.Y.

[21] Appl. No.: 574,321

[22] Filed: Aug. 29, 1990

[30] Foreign Application Priority Data

Sep. 11, 1989 [GB] United Kingdom ..... 8920537

[51] Int. Cl.[5] ..... H01R 4/66

[52] U.S. Cl. ..... 439/108; 439/62

[58] Field of Search ..... 439/62, 60, 65, 59, 439/629-637

[56] References Cited

U.S. PATENT DOCUMENTS

| | | | |
|---|---|---|---|
| 3,196,377 | 7/1965 | Minich | 439/60 |
| 3,969,815 | 7/1976 | Hacke et al. | 439/85 |
| 4,591,220 | 5/1986 | Impey | 439/85 |
| 4,710,133 | 12/1987 | Lindeman | 439/62 |

FOREIGN PATENT DOCUMENTS 2185160 7/1987 United Kingdom .

OTHER PUBLICATIONS

IBM Technical Disclosure Bulletin, vol. 8, No. 3, Aug. 1965, pp. 351 & 352.

IBM Technical Disclosure Bulletin, vol. 21, No. 9, Feb. 1979, pp. 3866 & 3867.

*Primary Examiner*—Larry I. Schwartz

*Assistant Examiner*—Hien P. Vu

*Attorney, Agent, or Firm*—Thomas L. Peterson

[57] ABSTRACT

An electrical shielding arrangement is provided wherein an edge connector (5) interconnects first and second circuit boards (1, 16). One of the boards (1) on which the edge connector lies includes a metal ground plane (2) and a plated through hole (3) which extends through the board and which makes effective contact with the metal ground plane. The plated through hole receives a metal fixing pin (4) of compliant metal which extends from the connector body (30) and is press fit into the hole (3). The forward end of the pin is positioned to engage a conductive layer (20s) at the leading edge of the second board, which is connected to the ground plane (19) of the second board. Thus, the pin (3) interconnects the ground planes (2, 19) of the two boards.

3 Claims, 1 Drawing Sheet

Fig. 2.
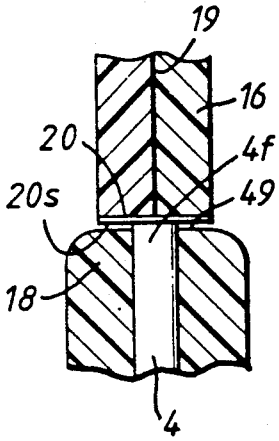
Fig. 1.
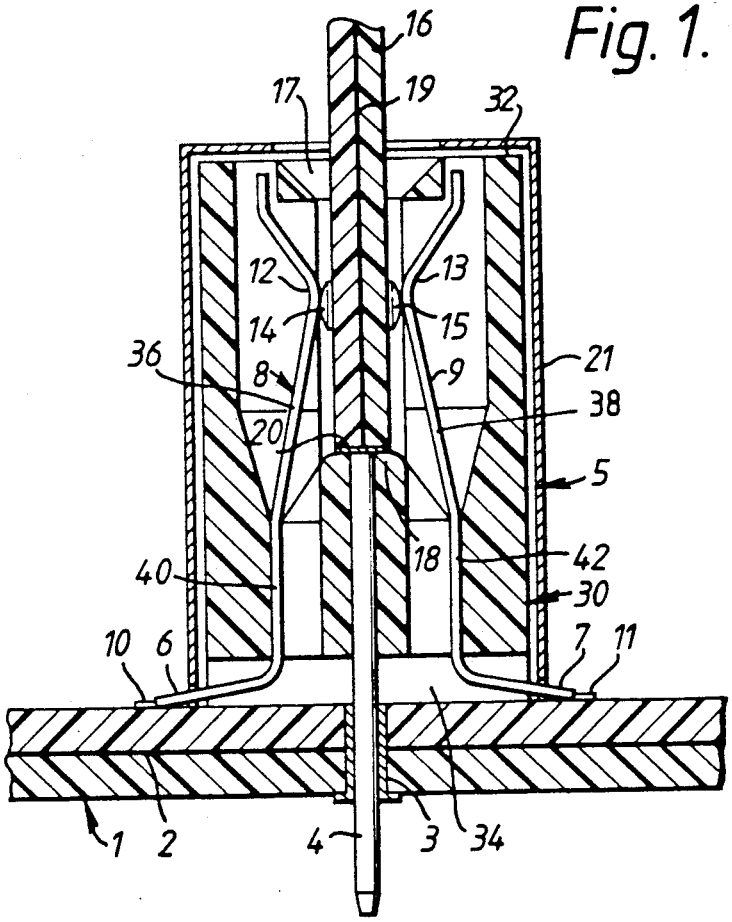
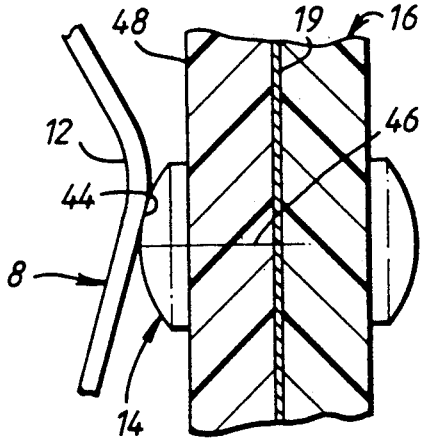
Fig. 3.

ELECTRICAL CONNECTING ARRANGEMENT

BACKGROUND OF THE INVENTION

This invention relates to electrical connecting arrangements that include edge connectors provided with spring contacts. The spring contacts have front parts that engage contact pads at or near the edge of a second printed circuit or wiring board. Such engagement occurs when the leading edge of the board is inserted through an opening at the front of a connector body into the usual edge-receiving cavity of the body. Edge connectors of this construction are described in British Patent Applications Nos. 8824179 and 8919167. British Patent Application No. 8824179 describes electrical edge connectors whose rear ends are adapted to be secured to back-plane printed circuit or wiring first boards by one or more pins or studs of compliant metal which project from the rear of the edge connector. The pins are press or force fit into holes provided in the first board. As the pins are pressed into the holes in the first board, projecting rear ends of the connector spring contacts are urged into pressure engagement (they may also be soldered) with contact pads provided on the first board.

The present invention provides an effective electrical shielding arrangement for electrical connecting arrangements having printed circuit or wiring boards interconnected through electrical connectors of the construction described above.

SUMMARY OF THE INVENTION

According to the present invention, an electrical shielding arrangement is provided for first and second circuit boards interconnected by an electrical connector. The first board includes a conductive ground plane and at least one plated through hole connected to the ground plane. The connector includes a conductive pin or stud, preferably of compliant metal, with a rear end that is press or force fit into the plated through hole. The forward end of the pin is positioned for electrical coupling, preferably directly, with a metal ground plane included in the second circuit board.

The connector has an insulative body with a cavity open at the front of the body for receiving the leading edge of the second circuit board. Contact pads on the second board near its leading edge, are engaged by forward portions of spring contacts of the connector. The leading edge of the second board is electrically conductive. An abutment that limits the depth of second board insertion, can include a contact that is part of or that is connected to the pin that engages the first board. The conductive leading edge of the second board is preferably connected to a ground plane of the second board, so the ground planes of the two boards are interconnected through the pin.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional view of a connecting arrangement constructed in accordance with the present invention.

FIG. 2 is an enlarged view of a portion of the arrangement of FIG. 1, at the second board leading edge.

FIG. 3 is an enlarged view of a portion of the arrangement of FIG. 1, at a contact pad of the second board.

DESCRIPTION OF THE INVENTION

FIG. 1 shows an electrical connecting arrangement which includes first and second circuit boards 16 and an edge connector 5 that connects them. The first board 1 is a multi-layer board having, in the present example, a central ground plane 2, although the ground plane could alternatively be located at any other position on or within the board (e.g. surface located). The board 1 has a plurality of plated through holes 3. The connector includes a body 30 of insulative material having front and rear ends 32, 34. A fixing pin or stud 4 of compliant metal extends from the base or rear end of the connector body and is received in the plated through hole 3 of the first board, as by press or force fit into the hole 3. The walls or plating of the hole 3 is electrically connected with the ground plane 2 of the board 1.

The edge connector has two rows of spring contacts 8 and 9. Each spring contact has a free forward portion 36, 38 with a curved part 12, 13 that engages contact pads on the second circuit board 16. Each contact also has a middle portion 40, 42 fixed in the insulative body, and a rearward portion 6, 7 extending from the rear of the body. The rearward portions 6, 7 press against contact pads 10, 11 on the first board.

The pin 4 secures the edge connector 5 to the first board 1. Also, since the pin is forced or pressed into the plated hole 3, the projecting rearward portions 6 and 7 of the spring contacts 8 and 9 of the connector are held in pressure engagement with appropriately positioned contact pads 10, 11 on the board surface.

The curved parts 12, 13 of the spring contacts engage dome-shaped contact pads 14, 15 attached to opposite faces of the second circuit board 16. Such engagement with the dome-shaped pads 14, 15 occurs when the leading edge 20 of the second board is inserted into an edge-receiving cavity 17 of the connector body which extends into the front end 32 of the connector body. A connector body abutment 18 limits the depth of insertion of the second board into the cavity. The positions of the dome-shaped contacts 14, 15 relative to the leading edge 20 of the circuit board 16, and the distance of connector abutment 18 from the front end of the cavity 17, is chosen to assure that the spring contacts engage selected locations on the contact pads 14, 15.

As the board 16 is inserted into the cavity; the curved portions 12 and 13 of the spring contacts 8 and 9 ride up over the convex profile of the dome-shaped contacts 14 and 15 and engage locations 44 on the contact pad. The contact pad has a "reverse incline" at the location 44, in that points on the contact pad lying progressively move rearward, lie progressively closer to the board face 48. As a result, the force of the spring contact such as 8 on pads such as 14 biases the board downwardly. This contact arrangement and the advantages thereof are fully described in the previously mentioned British Patent Application No. 8919167.

The downward biasing of the second board 16 causes the board leading edge 20 to press against the connector abutment 18. The board leading edge 20 includes a conductive surface or layer **20*s* (FIG. 2) that is connected to the ground plane 19 of the board. The connector abutment 18 is electrically connected to the metal pin 4, preferable by positioning the forward end 4*f* (FIG. 2) of the pin so it lies forward of a surrounding body wall 49, so the pin end 4***f* forms the abutment that engages the conductive surface 20*s* of the second board leading edge. The pin 4 is thus electrically coupled to the conductive leading edge of the second board 16 and to the ground plane 19 of the board. The leading edge 20 of the board may be plated to make it electrically conductive. While the pin 4 is shown as forming a pin device that connects directly to the leading edge of the second board, a pin device can be used that includes an additional metal part acting as the abutment and connected to a pin.

A metal shroud or shielding cover 21 may be fitted over the body of the connector so as to enclose a substantial part thereof, as shown, in order to improve shielding. Although for optimum shielding it is desirable that uninterrupted electrical connections are effected between the various parts of the shielding arrangement through the electrical connector it should be appreciated that small interruptions may occur in the shielding path without detracting significantly from the general accepted level of effectiveness of the arrangement for electrical shielding purposes.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. In an electrical connecting arrangement which includes first and second circuit boards and a connector, said first board having a plurality of conductors and said second board having a plurality of conductors including contact pads, said connector having an insulative body with a rear body end lying n said first board and with a front body end forming an opening to a body cavity into which said second board is inserted, said connector having a plurality of spring contacts with deflectable forward portions in said cavity for engaging said conductive pads on said second board and with rear ends for engaging conductors on said first board, and each of said boards has a ground plane, the improvement wherein:

said second board has a leading edge which is electrically conductive and connected to the second board ground plane and said first board has a hole with conductive walls connected to said second board ground plane;

said connector having an electrically conductive pin mounted on said connector body and having a forward end positioned to abut said leading edge of said second board to limit the depth of second board insertion into said connector and to electrically connect to said conductive leading edge of said second board when said second board is fully inserted into said cavity, said pin having a rearward end that projects into said hole of said second board and engages said conductive walls thereof.

2. The improvement described in claim 1 wherein: p1 said pin is fixed to said connector body and said rearward end of said pin is in interference fit with said walls of said hole, whereby said pin holds said connector to said first board.

3. An electrical connecting arrangement comprising:

first and second circuit boards, said first board having a ground plane and walls forming a hole, with at least a portion of the hole walls being electrically conductive and connected to said ground plane, and said second board having a ground plane, a leading edge, and a first face with a plurality of contact pads thereon lying near said leading edge;

an edge connector having an insulative body wherein said body has a front end and has a board-receiving cavity open at said front end, said connector having a plurality of spring contacts mounted in said body and having forward spring contact portions positioned to engage said pads of said second board as said second board is inserted in a rearward direction into said cavity, said connector body also having a rear end lying over a region of said first board which includes said plated hole;

said second board having a conductive layer lying over said second board leading edge and which is connected to said second board ground plane;

said connector including an electrically conductive pin fixed to said connector insulative body, said pin having a rearward portion lying in interference fit with the walls of said hole of said first board, said pin having a forward end forming an electrically conductive abutment region at the rear of said cavity for abutting said conductive layer lying over said second board leading edge to limit its depth of insertion into said cavity and to electrically connect to said conductive layer lying over said leading edge of a fully inserted board, to thereby couple said ground plane of said boards and hold said connector to said first board.

* * * * *